US006932401B1

(12) United States Patent
Eekhoff et al.

(10) Patent No.: US 6,932,401 B1
(45) Date of Patent: Aug. 23, 2005

(54) CASKET TRANSPORTING APPARATUS

(75) Inventors: David L. Eekhoff, Sioux Center, IA (US); Joel D. Van Den Brink, Rock Rapids, IA (US)

(73) Assignee: Link Mfg., Ltd., Sioux Center, IA (US)

( * ) Notice: Subject to any disclaimer, the term of this patent is extended or adjusted under 35 U.S.C. 154(b) by 24 days.

(21) Appl. No.: 10/963,033

(22) Filed: Oct. 11, 2004

(51) Int. Cl.[7] ..... A61G 21/00

(52) U.S. Cl. ..... 296/16; 296/18; 414/495; 414/679

(58) Field of Search ..... 296/16, 17, 18, 296/24.3; 414/495, 679

(56) References Cited

U.S. PATENT DOCUMENTS

| | | | | |
|---|---|---|---|---|
| 1,925,964 A * | 9/1933 | Koppe | 296/16 |
| 3,372,819 A * | 3/1968 | Kellogg | 414/461 |
| 3,718,227 A * | 2/1973 | Swift | 414/495 |
| 5,853,280 A * | 12/1998 | Lohr | 414/495 |
| 6,758,648 B1 * | 7/2004 | Eekhoff et al. | 414/495 |

* cited by examiner

*Primary Examiner*—Jason Morrow
(74) *Attorney, Agent, or Firm*—Thomte, Mazour & Niebergall; Dennis L. Thomte

(57) ABSTRACT

A casket transporter which is positioned in a vehicle and which is adapted to support a pair of caskets on a lower deck and a pair of caskets on an upper deck. The upper deck is movable from a transport position to a loading position.

12 Claims, 5 Drawing Sheets

CASKET TRANSPORTING APPARATUS

BACKGROUND OF THE INVENTION

1. Field of the Invention

This invention relates to an apparatus for transporting four caskets in a small van or other small vehicle. More particularly, the instant invention relates to a double-deck apparatus including upper and lower decks with the upper deck being pivotally movable between upper and lower positions with respect to the lower deck so that both the upper and lower decks may support a pair of caskets thereon.

2. Description of the Related Art

Link Mfg., Ltd. ("Link") of Sioux Center, Iowa, the assignee of this invention, has manufactured Double Deck apparatuses or systems which have been installed in full size Chevrolet, Ford and Dodge vans with the Double Deck systems comprising a lower deck positioned on the floor of the van with an upper deck pivotally mounted thereon and which is movable between upper and lower positions with respect to the lower deck. The upper and lower decks are used to support and transport multiple caskets, cots, stretchers, cremation trays or the like. In the DD200 double-deck system of Link, the upper deck is raised and lowered utilizing an electric actuator with that actuator moving a front torsion bar which lifts the front of the upper deck. In the DD200 Double Deck system of Link, there is a tie rod on each side, running from the front torsion bar to the rear swing arms with the rear swing arms lifting the rear of the upper deck.

Although the DD200 Double Deck system of Link has met with considerable success, the DD200 Double Deck system cannot be installed in certain vans which are smaller than the full size vans described above. To satisfy that need, the invention of U.S. Pat. No. 6,758,648 was developed. Even though the invention of the '648 patent has also met with success, the assignee of this invention believes that the instant invention is an improvement over the apparatus of the '648 patent both in cost and design.

SUMMARY OF THE INVENTION

An apparatus for transporting four caskets is described for use in the cargo area of a small van having a cargo floor. The apparatus of this invention comprises a lower casket support deck which is mounted on the vehicle floor and which has a forward end, a rearward end, and opposite sides. A first upstanding support, having upper and lower ends, is operatively secured to the vehicle at the forward end of the lower deck adjacent one side thereof. A second upstanding support, having upper and lower ends, is operatively secured to the vehicle at the forward end of the lower deck adjacent the other side thereof. A lower casket support deck is positioned on the floor of the vehicle and has a forward end, a rearward end, and opposite sides. An upper casket support deck is positioned above the lower casket support deck and has a forward end, a rearward end, and opposite sides. The forward end of the upper casket support deck is pivotally secured to the first and second upstanding supports. A first lift arm having upper and lower ends is movably secured at its upper end to one side of the upper casket support deck. The upper end of a second lift arm is movably secured to the other side of the upper casket support deck. The first and second lift arms are operatively pivotally secured, intermediate the lengths thereof, to a support frame which is secured to the vehicle and are selectively movable between raised and lowered positions. The lift arms are moved between their raised and lowered positions by an actuator assembly operatively secured thereto. The lift arms, when in their raised positions, cause the upper casket support deck to be positioned in a generally horizontally disposed condition above the lower casket support deck for casket transport. The lift arms, when in their said lowered positions, cause the rearward ends of the upper casket support deck to be lowered into a casket loading or unloading position. A pair of pivotal ramps are secured to the support frame and are selectively pivotally movable between operative and stowed positions.

When it is desired to transport caskets, the lift arms are lowered by the actuator so that the rearward end of the upper casket support deck is lowered to a position where two caskets may be slidably moved upwardly on the ramps onto the upper casket support deck and positioned thereon. The actuator is then actuated which causes the rearward end of the upper casket support deck to be raised so that the upper casket support deck is positioned in a generally horizontal position above the lower casket support deck. A pair of caskets may then be slidably positioned onto the lower casket support deck. When it is desired to remove the caskets from the vehicle, the caskets on the lower casket support deck are first removed and then the rearward end of the upper casket support deck is lowered so that the caskets on the upper casket support deck may be slidably removed therefrom. The apparatus of this invention may be easily installed in vans or the like and may be moved from one van to another should the van need replacing.

It is therefore a principal object of the invention to provide an improved apparatus for transporting four caskets in a vehicle such as a small van.

A further object of the invention is to provide an improved apparatus of the type described above which is compact and which includes a minimum of moving parts.

Still another object of the invention is to provide an apparatus of the type described above which includes an upper casket support deck and a lower casket support deck with the upper casket support deck being pivotally mounted so that the rearward end thereof may be lowered into a casket loading or unloading position.

Still another object of the invention is to provide an apparatus of the type described above which may be easily moved from one vehicle to another should the vehicle need replacement.

These and other objects will be apparent to those skilled in the art.

DETAILED DESCRIPTION OF THE INVENTION

Figure 1:
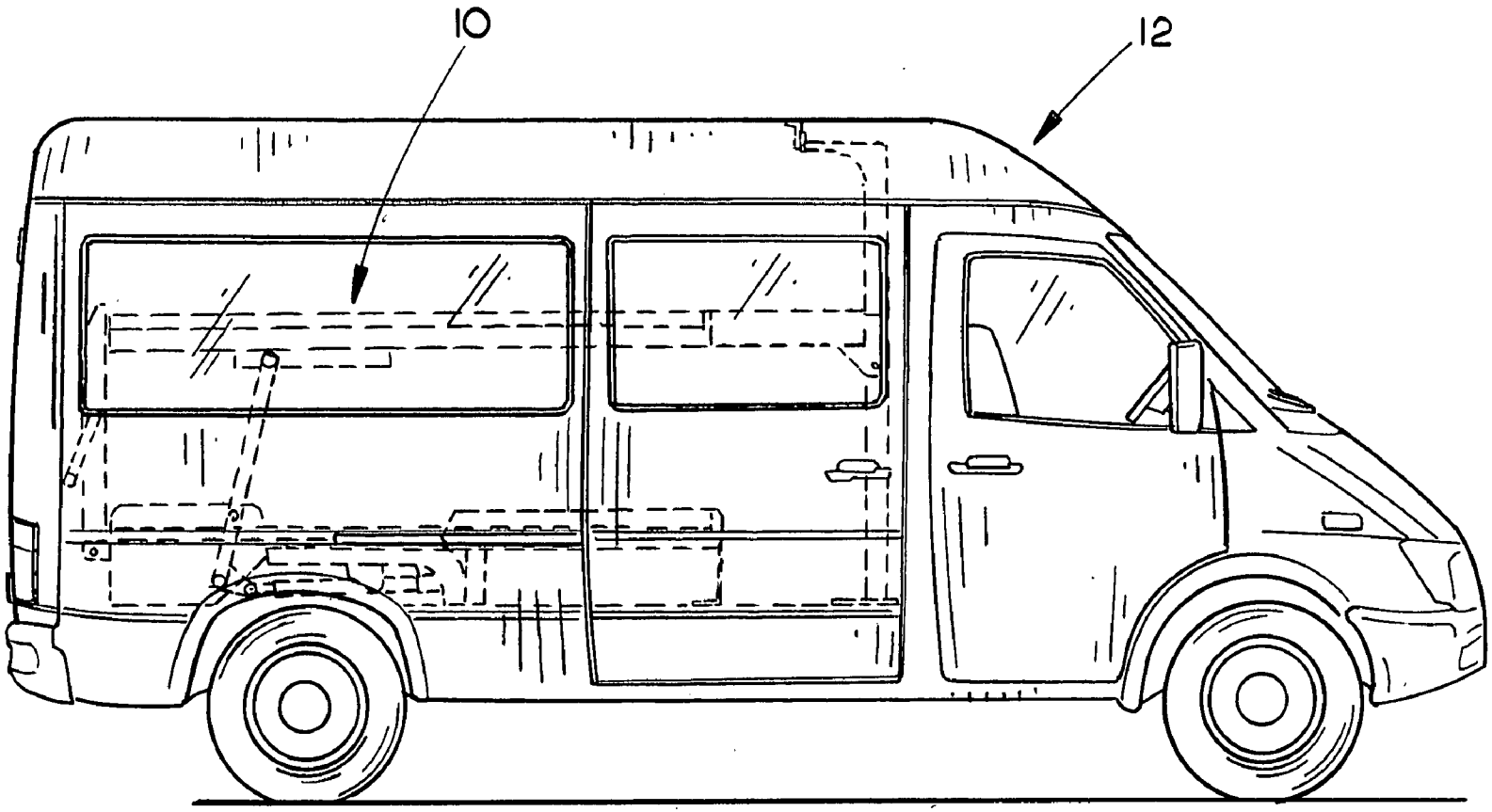
FIG. 1 is a side elevational view of a vehicle having the casket transporting apparatus of this invention mounted therein.
Figure 2:
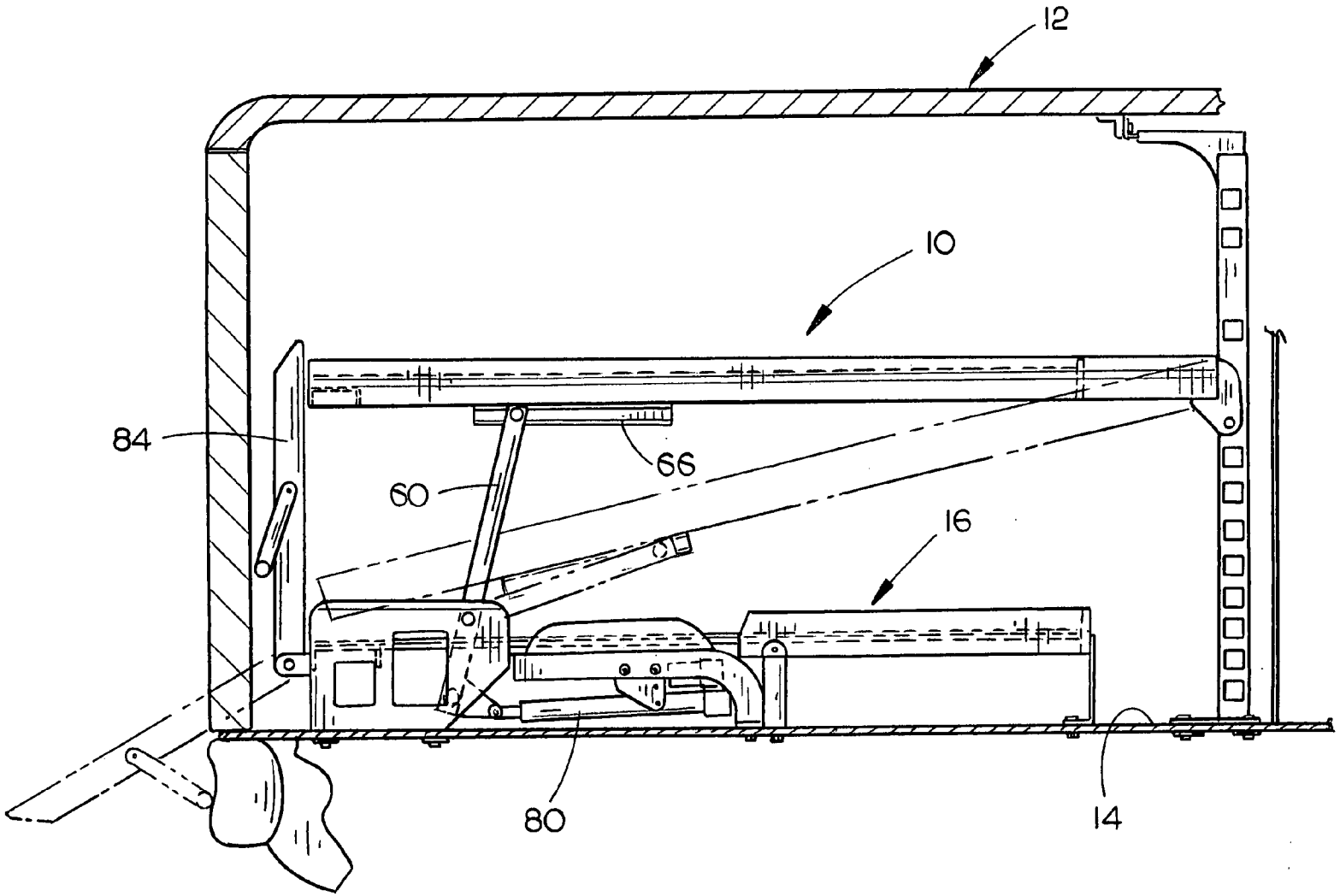
FIG. 2 is a partial longitudinal sectional view of the vehicle illustrating the apparatus of this invention in its transport position with the broken lines illustrating alternate positions.
Figure 3:
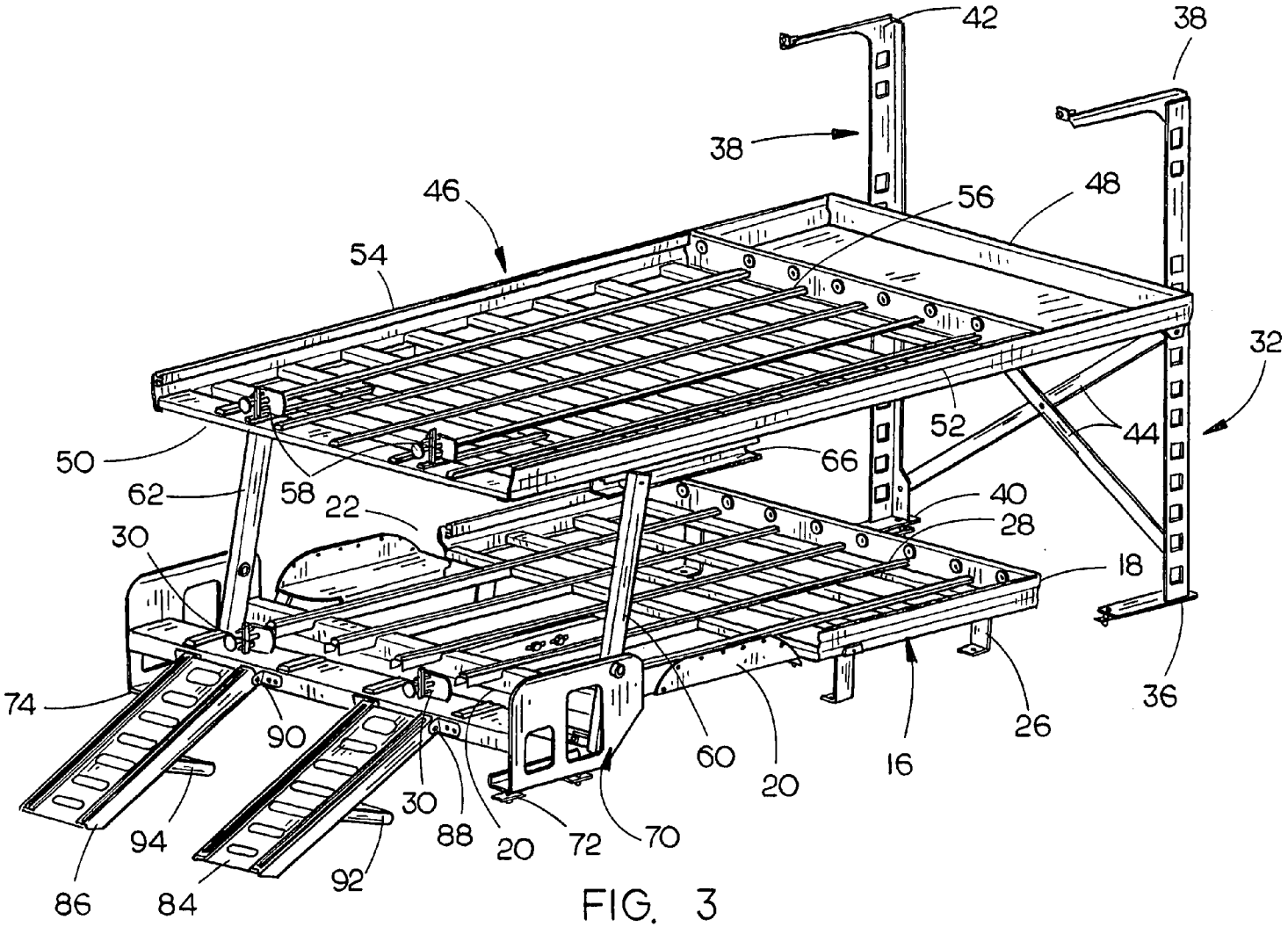
FIG. 3 is a rear perspective view of the apparatus of this invention in a transport position.
Figure 4:
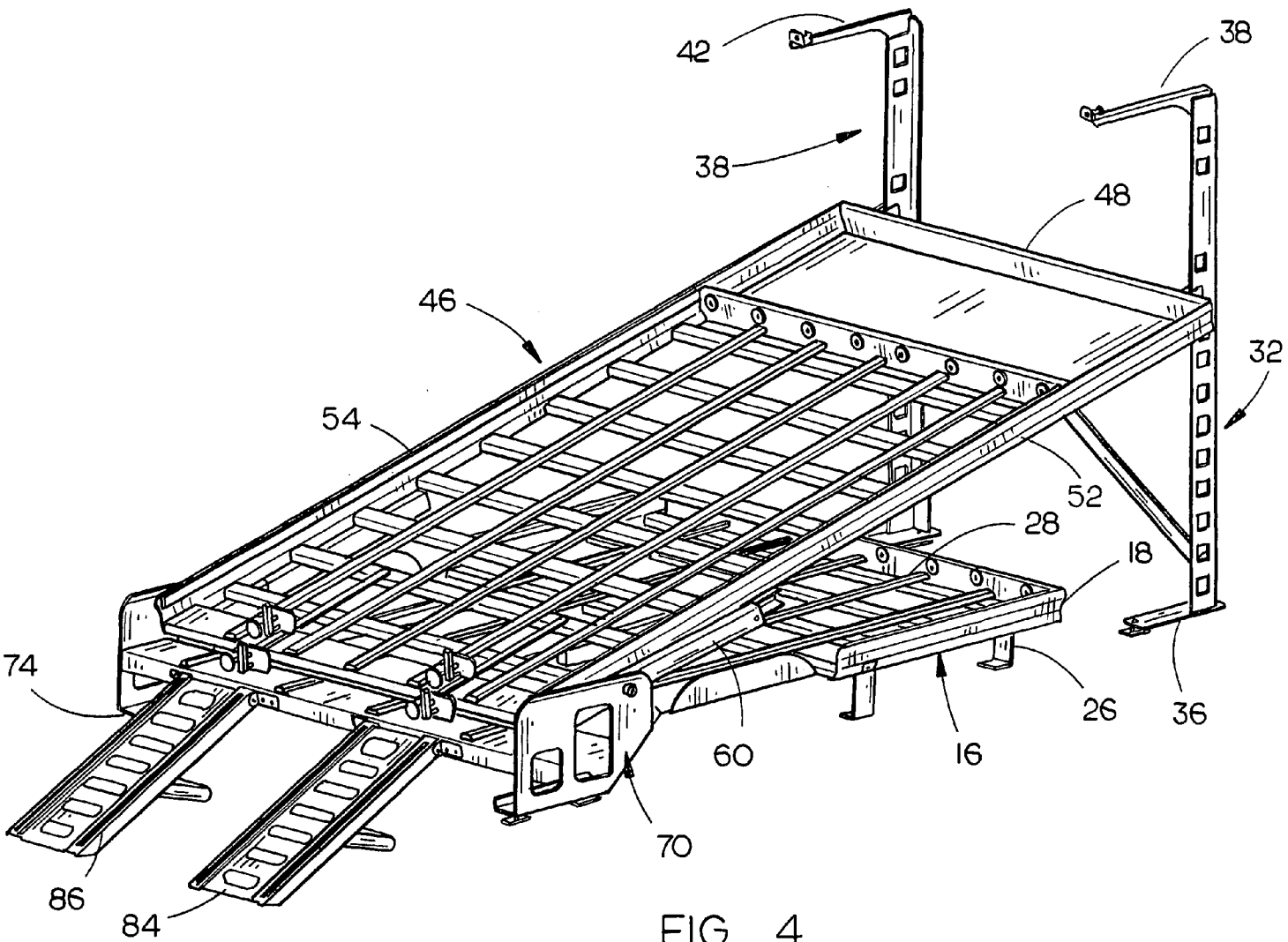
FIG. 4 is a rear perspective view of the apparatus of this invention in its lowered position and with the ramps extended.
Figure 5:
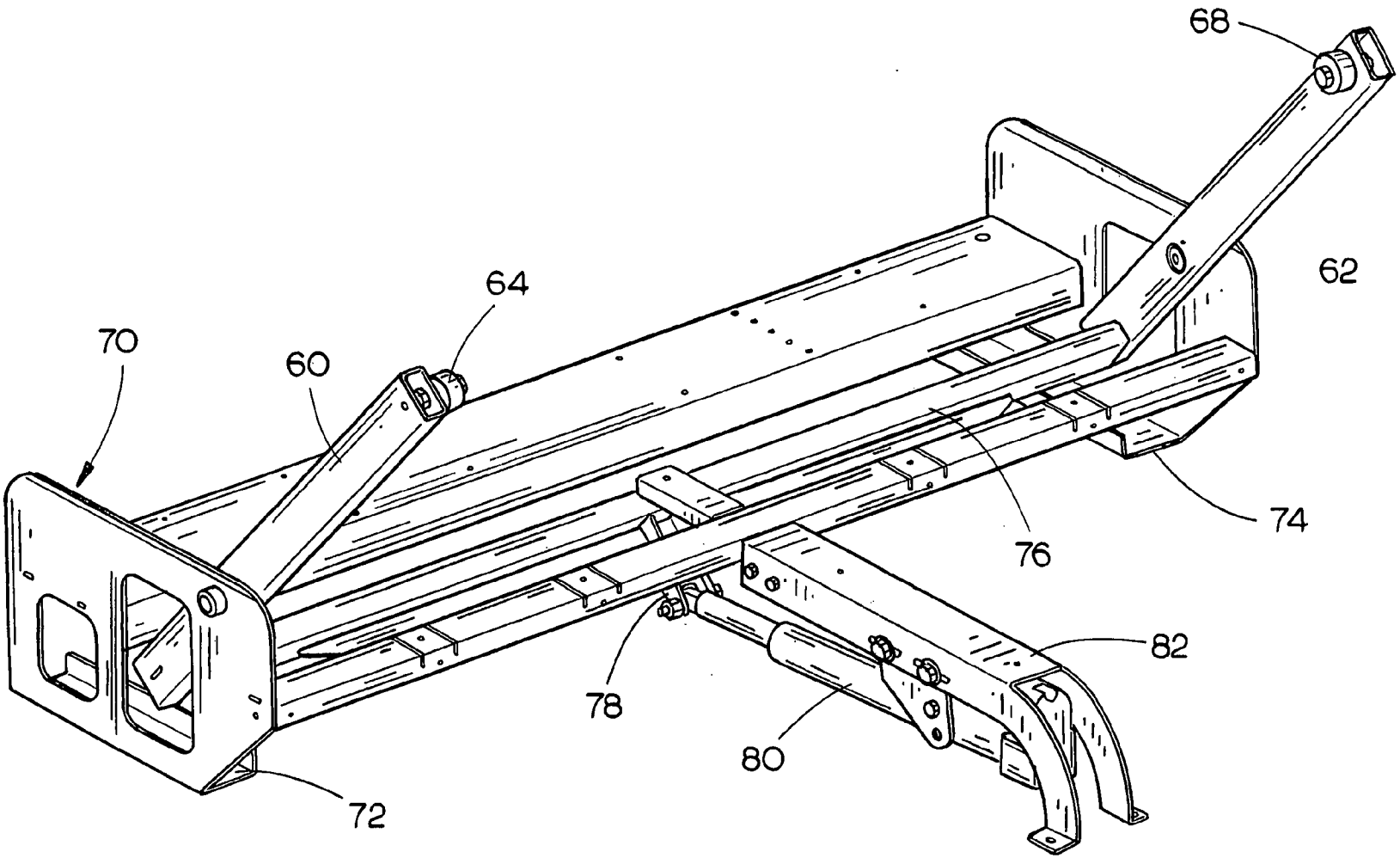
FIG. 5 is a front perspective view of the apparatus for raising the upper deck.

The apparatus of this invention is referred to generally by the reference numeral which is adapted to be installed in the cargo area of a small vehicle 12 such as a van or the like including a cargo floor 14. Apparatus 10 includes a lower casket support deck 16 having a forward end 18, rearward end 20, and opposite sides 22 and 24. The deck 16 is secured to the vehicle or to the floor by any convenient means such as by stand-offs or supports 26. Deck 16 includes a plurality of longitudinally extending and spaced-apart slide bars 28 so enable the caskets to be easily slidably moved thereon. Support deck 16 is provided with a pair of casket stops 30 at the rearward end thereof which prevents the caskets thereon from slidably moving thereon.

The numeral 32 refers to a first upstanding support having a lower end 34 and an upper end 36. The support 32 is secured to the vehicle or to the cargo floor by any convenient means. The numeral 38 refers to a second upstanding support having a lower end 40 and an upper end 42 and which is secured at its lower end to the vehicle or to the cargo floor by any convenient means. The upper ends of the supports 32 and 38 are also secured to the roof of the vehicle so that the supports 32 and 38 are stable. Bracing 44 is secured to the supports 32 and 38 and extends therefrom to aid in stabilizing the supports.

The numeral 46 refers to the upper casket support deck of this invention having a forward end 48, rearward end 50, and opposite sides 52 and 54. Support deck 46 is also provided with a plurality of longitudinally extending slide bars 56 designed to permit the caskets supported thereon to easily slide thereon. The rearward end of upper support deck 46 is provided with a pair of casket stops 58 so maintain the caskets thereon in a stationary fashion. The forward end of the upper casket support deck 46 is pivotally secured, about a horizontal axis, to the supports 32 and 38 so that the support deck 46 may be moved from a raised casket supporting position which is generally horizontally disposed above the lower deck 16 to a lowered position wherein the rearward end of the deck 46 is lowered to a position for casket loading and unloading.

The numeral 60 refers to a first lift arm while the numeral 62 refers to a second lift arm. Lift arm 60 is positioned at one side of the decks 16 and 46 lift arm 62 is provided at the other side of decks 16 and 46. The upper end of lift arm 60 has a roller 64 mounted thereon which is movably received by a track 66 secured to one side of upper deck 46. Similarly, lift arm 62 has a roller 68 mounted thereon which is received within a track at the other side of the deck 46.

Lift arms 60 and 62 are pivotally secured, intermediate their lengths thereof, to a support frame 70 which is secured to the vehicle or floor at 72 and 74, respectively. An elongated member 76 is secured to and extends between the lower ends of lift arms 60 and 62, as illustrated in the drawings. Bracket 78 is secured to elongated member 76 and has one end of a length extensible ram or actuator 80 secured thereto. Preferably, the actuator 80 is a screw actuator such as that utilized in U.S. Pat. No. 6,758,648 but the actuator or ram could be a hydraulic cylinder or the like. The other end of the actuator 80 is secured to a frame member 82 which is secured to the vehicle or floor of the vehicle as well as to the frame 70, as illustrated in the drawings. Thus, when the ram or actuator 80 is retracted, the lift arms 60 and 62 are moved from their lowered position to their raised position and when the ram 80 is extended, the lift arms 60 and 62 are moved to the lowered position.

When the lift arms 60 and 62 are in their raised position, as previously described, the rearward end of the upper deck 46 will be positioned above lower deck 16 so that the upper deck 46 is substantially horizontally disposed. When the actuator 80 is extended, the lift arms 60 and 62 will be pivotally moved to their lowered position so that the rearward end of the deck 46 is in its lowered position to facilitate the loading or unloading of caskets with respect to the deck 46.

The numerals 84 and 86 refer to ramps which are pivotally connected to support frame 70 at 88 and 90, respectively. Ramps 84 and 86 are movable between operative and stowed positions, as seen in the drawings. Ramps 84 and 86 are provided with adjustable stops 92 and 94, respectively, which engage the rear bumper of the vehicle to properly position the ramps in their operative position so that a casket cart may be positioned adjacent thereto.

The method of utilizing the apparatus is as follows. When it is desired to transport caskets, the ramps 84 and 86 are lowered to their operative position and the upper deck 46 is lowered through the use of the ram or actuator 80 so that caskets may be slidably moved upwardly from the ramps 84 and 86 onto the deck 46. When the caskets are positioned on the deck 46, the stops 58 are manipulated to secure the caskets onto the upper deck. When the caskets have been positioned on the upper deck 46, the lift arms 60 and 62 are moved from their lowered position to their raised position so that the upper deck 46 is in a substantially horizontally disposed position above deck 16. A pair of caskets may then be positioned on the lower deck 16. When it is desired to remove the caskets from the apparatus, the caskets on the lower casket support deck are first removed. The rearward end of the upper deck is then lowered so that the caskets thereon may be removed therefrom.

Thus it can be seen that a novel and unique casket transporter has been disclosed which involves a minimum of moving parts and which is economical of manufacture. The casket transporter of this invention is easily installed in a small van or the like and may be moved from one van to another should the van require replacement.

Thus it can be seen that the invention accomplishes at least all of its stated objectives.

We claim:

1. In combination with a vehicle having an interior compartment above a floor, the vehicle having rearward and forward ends and a door at the rearward end thereof to permit selective access to the interior compartment, comprising:

a lower casket support deck mounted on the vehicle floor and having a forward end, a rearward end, and opposite sides;

a first upstanding support, having upper and lower ends, operatively secured to the vehicle at the forward end of said lower deck adjacent one side thereof;

a second upstanding support, having upper and lower ends, operatively secured to the vehicle at the forward end of said lower deck adjacent the other side thereof;

an upper casket support deck positioned above said lower casket support deck and having a forward end, a rearward end, and opposite sides;

said forward end of said upper casket support deck being pivotally secured to said first and second upstanding supports;

a first lift arm having upper and lower ends;

a second lift arm having upper and lower ends;

said upper ends of said first lift arm being movably secured to one side of said upper casket support deck;

said upper end of said second lift arm being movably secured to the other side of said upper casket support deck;

said first and second lift arms being operatively pivotally secured to the vehicle intermediate the lengths thereof;

said lift arms being selectively movable between raised and lowered positions;

said lift arms, when in their said raised positions, causing said upper casket support deck to be positioned in a generally horizontally disposed condition above said lower casket support deck for casket transport;

said lift arms, when in their said lowered positions, causing the rearward end of said upper casket support deck to be lowered into a casket loading or unloading position.

2. The combination of claim 1 wherein a length extensible ram is operatively secured to said lift arms adapted to move said lift arms between their said raised and lowered positions.

3. The combination of claim 2 wherein an elongated member is secured to and extends between said lower ends of said lift arms and wherein said length extensible ram is operatively secured to said elongated member.

4. The combination of claim 2 wherein said length extensible ram comprises a screw actuator.

5. The combination of claim 2 wherein said length extensible ram has first and second ends and wherein said first end of said extensible ram is operatively connected to said lift arms and wherein said second end of said length extensible ram is operatively secured to the vehicle.

6. The combination of claim 1 wherein each of said lift arms has a roller mounted thereon at the upper end thereof which rollably engages a track arm on said upper casket support deck.

7. The combination of claim 1 wherein the rearward ends of each of said casket support decks have casket stops provided thereon.

8. The combination of claim 1 wherein each of said casket support decks has slide rails provided thereon.

9. The combination of claim 1 wherein a casket support ramp, having rearward and forward ends, is pivotally secured at its forward end to the vehicle at the rearward end of said lower casket support deck.

10. The combination of claim 1 wherein a pair of support ramps, having rearward and forward ends, are pivotally secured at their forward ends to the vehicle at the rearward end of said lower casket support deck.

11. The combination of claim 9 wherein said ramp is pivotally movable between a lowered position to a raised stowed position.

12. The combination of claim 10 wherein said support ramps are pivotally movable between a lowered position to a raised stowed position.

* * * * *